US010893995B2

(12) United States Patent
Blackwell

(10) Patent No.: US 10,893,995 B2
(45) Date of Patent: Jan. 19, 2021

(54) LIFT FOR EXTREMITY SURGICAL POSITIONING DEVICE

(71) Applicant: INNOVATIVE MEDICAL PRODUCTS, INC., Plainville, CT (US)

(72) Inventor: Timothy Blackwell, Plainville, CT (US)

(73) Assignee: INNOVATIVE MEDICAL PRODUCTS, INC., Plainville, CT (US)

( * ) Notice: Subject to any disclaimer, the term of this patent is extended or adjusted under 35 U.S.C. 154(b) by 728 days.

(21) Appl. No.: 15/641,211

(22) Filed: Jul. 3, 2017

(65) Prior Publication Data

US 2017/0312158 A1 Nov. 2, 2017

Related U.S. Application Data

(63) Continuation-in-part of application No. 13/397,783, filed on Feb. 16, 2012, now Pat. No. 9,693,923.
(Continued)

(51) Int. Cl.
*A61G 13/12* (2006.01)
*A61G 7/075* (2006.01)
(Continued)

(52) U.S. Cl.
CPC ..... *A61G 13/0036* (2013.01); *A61G 7/075* (2013.01); *A61G 7/1092* (2013.01);
(Continued)

(58) Field of Classification Search
CPC ..... A61G 7/065; A61G 7/075; A61G 7/0755; A61G 7/1082; A61G 7/1092;
(Continued)

(56) References Cited

U.S. PATENT DOCUMENTS 175,602 A 4/1876 Follett
832,035 A 10/1906 Germann
(Continued)

*Primary Examiner* — Keri J Nelson
(74) *Attorney, Agent, or Firm* — Damian Wasserbauer, Esq.; Wasserbauer Law LLC

(57) ABSTRACT

The present inventive subject matter describes a device and system for positioning, adjusting, and stretching a patient's extremity for surgical procedures where alignment is critical and minute adjustments may be required repeatedly. The device helps in maintaining the patient's extremity stationary, once the physician has selected the precise position for the elected procedure. The device uses using a combination of an articulating and a rotating frame, support plates and support rings that are attached to the extremity surgical positioning system. The system acts as a limb splint that is firmly attached to the surgical table. The support plates are attached to the patient via a series of adjustable straps preventing the extremity from moving independently of the support plate. A locking rack and gear configuration has adjustable locking pivot points that are positioned along and within the outer/inner proximal tube and outer/inner distal tube that lengthens or rotates various portions of the extremity.

1 Claim, 7 Drawing Sheets

Related U.S. Application Data

(60) Provisional application No. 61/443,318, filed on Feb. 16, 2011.

(51) Int. Cl.
*A61G 7/10* (2006.01)
*A61G 13/00* (2006.01)
*A61G 13/10* (2006.01)

(52) U.S. Cl.
CPC ..... *A61G 7/1096* (2013.01); *A61G 13/101* (2013.01); *A61G 13/125* (2013.01); *A61G 13/1235* (2013.01); *A61G 13/1245* (2013.01); *A61G 13/1295* (2013.01); *A61G 2200/56* (2013.01); *A61G 2200/58* (2013.01)

(58) Field of Classification Search
CPC .. A61G 7/1094; A61G 7/1096; A61G 7/1098; A61G 13/12; A61G 13/1235; A61G 13/124; A61G 13/1245; A61G 13/125
USPC ..... 128/845
See application file for complete search history.

(56) References Cited

U.S. PATENT DOCUMENTS

| | | | | |
|---|---|---|---|---|
| 4,974,830 | A | 12/1990 | Genovese et al. | |
| 5,290,222 | A | 3/1994 | Feng et al. | |
| 5,608,934 | A * | 3/1997 | Torrie | A61G 13/0036 5/624 |
| 6,491,273 | B2 | 12/2002 | King et al. | |
| 6,533,741 | B1 | 3/2003 | Lee et al. | |
| 6,764,458 | B2 * | 7/2004 | Polonchek | A61G 7/0755 128/845 |
| 6,953,443 | B2 | 10/2005 | Hay | |
| 7,152,261 | B2 | 12/2006 | Jackson | |
| 7,175,602 | B2 | 2/2007 | Diaz et al. | |
| 7,753,610 | B2 * | 7/2010 | Gehrke | A47C 20/021 403/109.3 |
| 7,951,097 | B2 | 5/2011 | Schaeffer | |
| 8,302,228 | B2 | 11/2012 | Aboujaoude | |
| 9,125,783 | B2 * | 9/2015 | Doak | A61M 5/1414 |
| 2004/0133979 | A1 | 7/2004 | Newkirk et al. | |
| 2004/0167455 | A1 | 8/2004 | Smart | |
| 2009/0030353 | A1 | 1/2009 | Bonutti et al. | |
| 2009/0308400 | A1 | 12/2009 | Wilson et al. | |
| 2010/0018537 | A1 | 1/2010 | Soto et al. | |
| 2012/0318278 | A1 | 12/2012 | Aboujaoude et al. | |

* cited by examiner

300

300

LIFT FOR EXTREMITY SURGICAL POSITIONING DEVICE

PRIOR APPLICATIONS

This continuation-in-part application claims priority under 35 U.S.C. § 120 of U.S. patent application Ser. No. 13/397,783, Filed Feb. 16, 2012, that claims priority to U.S. Provisional Applications No. 61/443,318 filed on Feb. 16, 2011, which is incorporated herein by reference.

BACKGROUND

The present inventive subject matter relates to an extremity surgical positioning device. In particular, a device or fixture that holds the limb of a patient stationary, so that medical procedures can be performed.

Traditionally surgery on the limb of a patient is accomplished by two individuals: the surgeon who is responsible for the actual operation on the limb and the assistant, who is responsible for holding the limb in the proper position while surgery occurs. To improve the job of the assistant, a number of devices are employed to help hold the limb in position. These devices vary, but typically consist of pads, straps, and various fixtures. For example, the Bryton Corporation (Indianapolis, Ind.) markets a number of products that aid in surgery. Also, Allen Medical Systems (Acton, Mass.), markets a variety of surgical positioning aids.

U.S. Pat. No. 5,290,222 (Mar. 1, 1994) issued to Feng discloses a non-invasive distraction system for ankle arthroscopy that utilizes a sling wrapped around the patient's ankle with an adjustable tension device that provides distraction of the leg and joints because the knee is cradled in a conventional urology leg holder and held relatively stationary. The device can be mounted on a standard operating table and utilizes the bent knee and the patient's weight to aid in the distraction.

U.S. Pat. No. 6,953,443 (Oct. 11, 2005) issued to Hay discloses a tibial distraction device that is essentially a triangular ramp that functions similarly to Guhl, but is not mounted directly to the operating table.

U.S. Pat. No. 6,491,273 (Dec. 10, 2002) issued to King et al. discloses a fluid filled "multi-joint arm-like" support with releasable and lockable limb sections for "holding, tools, instruments and the like."

Although these methods and devices have their uses, they have their pitfalls because they are not very precise, are prone to slippage, and can be difficult to adjust.

In general there is a need for an extremity surgical positioning device that provides:

Better access to surgical sites of the upper and lower extremities

Distraction of fractures and/or joints

Compression of fractures post re-alignment

Ability to rotate the distal aspect of the limb during distraction or compression.

Reduce the need for external fixation traction

Better access of intra-operative radiography

Un-obstructed x-ray view of bones through radio-lucent material.

It is therefore an object of the present inventive subject matter to provide an extremity surgical positioning device that is easily adjusted, capable of distraction, precise, easily mounted and dismounted to the operating table and slip resistant.

SUMMARY

The present inventive subject matter overcomes problems in the prior art by providing a device or fixture for positioning a patient's limb, whether that may be an upper or lower extremity.

In various operations and medical procedures it is required that the extremity is held stationary and located and adjusted precisely. An example of this would be surgery to pin or reconstruct a shattered bone. Alignment is critical and minute adjustments may be required. Furthermore, the device must not allow the patients extremity to move once the surgeon has selected the precise position for the elected procedure.

The present invention achieves these desired results through a combination of an articulating and rotating frame with thigh/upper arm supporting plate, lower leg/forearm supporting plate, and a foot/hand supporting plate that attach to support arms and act as a limb splint that is firmly anchored or attached to the surgical table. The supporting plates are securely attached to the patient via a series of adjustable straps around the patient's thigh/upper arm, shin/forearm, ankle/wrist, and foot/hand which not only prevents the extremity from moving independently of the supporting means, but do so in a non-invasive manner to the patient's tissue and skin.

Once the patient's extremity is securely attached to the supporting plates via the straps the surgeon can manipulate the extremity in a number of ways due to a rack and gear configuration and a myriad of adjustable pivot points positioned along and within the support arms to either lengthen or rotate various portions of the extremity against each other to align the extremity such as in repositioning of the limb or in setting a broken limb for example.

Each of these adjustable pivot points and rack and gear components have a means of locking them in a stationary position either by a friction means or by a spring and pawl mechanism. This aids in the precise adjustment of the extremity.

The inventive subject matter also describes an extremity surgical positioning device having a mount configurable to connect to a table, chair, or other equipment used for supporting and/or positioning a patient during surgery. The mount is rotatable in two degrees of freedom along the plane of the operating table; a proximal segment and distal segment having two opposing ends, and wherein each segment is telescopically retractable and extendable, and wherein one end of the proximal segment is connected to the table clamp; a proximal segment has an attachment point and a rotatable support point.

These and other embodiments are described in more detail in the following detailed descriptions and the figures. The foregoing is not intended to be an exhaustive list of embodiments and features of the present inventive subject matter. Persons skilled in the art are capable of appreciating other embodiments and features from the following detailed description in conjunction with the drawings.

LIST OF REFERENCE CHARACTERS

001: Patient
002: O. R. Table (Generic)
100: Extremity Surgical Positioning System
105: Table Clamp Cam-Lock
110: Table Clamp
115: Base
120: Rotary Joint Cam-Lock (Locks Adduction/Abduction)
125: Rotary Joint (Adduction/Abduction)
130: Proximal Hinge (Proximal Joint Flexion/Extension)
135: Proximal Hinge Cam-Lock (Locks Proximal Joint Flexion/Extension)
140: Outer Proximal Tube
145: Outer Proximal Tube Cam-Lock (Locks Int/Ext Rotation of Proximal Joint and Distraction/Compression)
150: Proximal Support Cam-Lock
155: Proximal Support Arm
160: Proximal Support Plate
165: Inner Proximal Tube
170: Proximal Distraction/Compression Ring
175: Proximal Distraction/Compression Engagement Lever
180: Intermediate Hinge (Distal Limb Flexion/Extension)
185: Intermediate Hinge Cam-Lock (Locks Distal Limb Flexion/Extension)
190: Distal Limb Support Cam-Lock
195: Distal Limb Support Arms
200: Distal Limb Support Plate
205: Distal Limb Support Plate Lock Knob
210: Outer Distal Limb Tube
215: Distal Tube Clocking Ring
220: Inner Distal Limb Tube
225: Distal Limb Distraction/Compression Ring
230: Distal Limb Distraction/Compression Engagement Lever
235: Foot/Hand Support Clocking Lever
240: Foot/Hand Plate Ball Joint Cam-Lock
245: Foot/Hand Support Arm
250: Foot/Hand Plate Ball Joint
255: Foot/Hand Plate
260: Ring Support
265: Ring Support Cam-Lock
270: Ring Support Rings (Vary in Size)
275: Ring Support Ring Retention Pin

DETAILED DESCRIPTION

Figure 1:
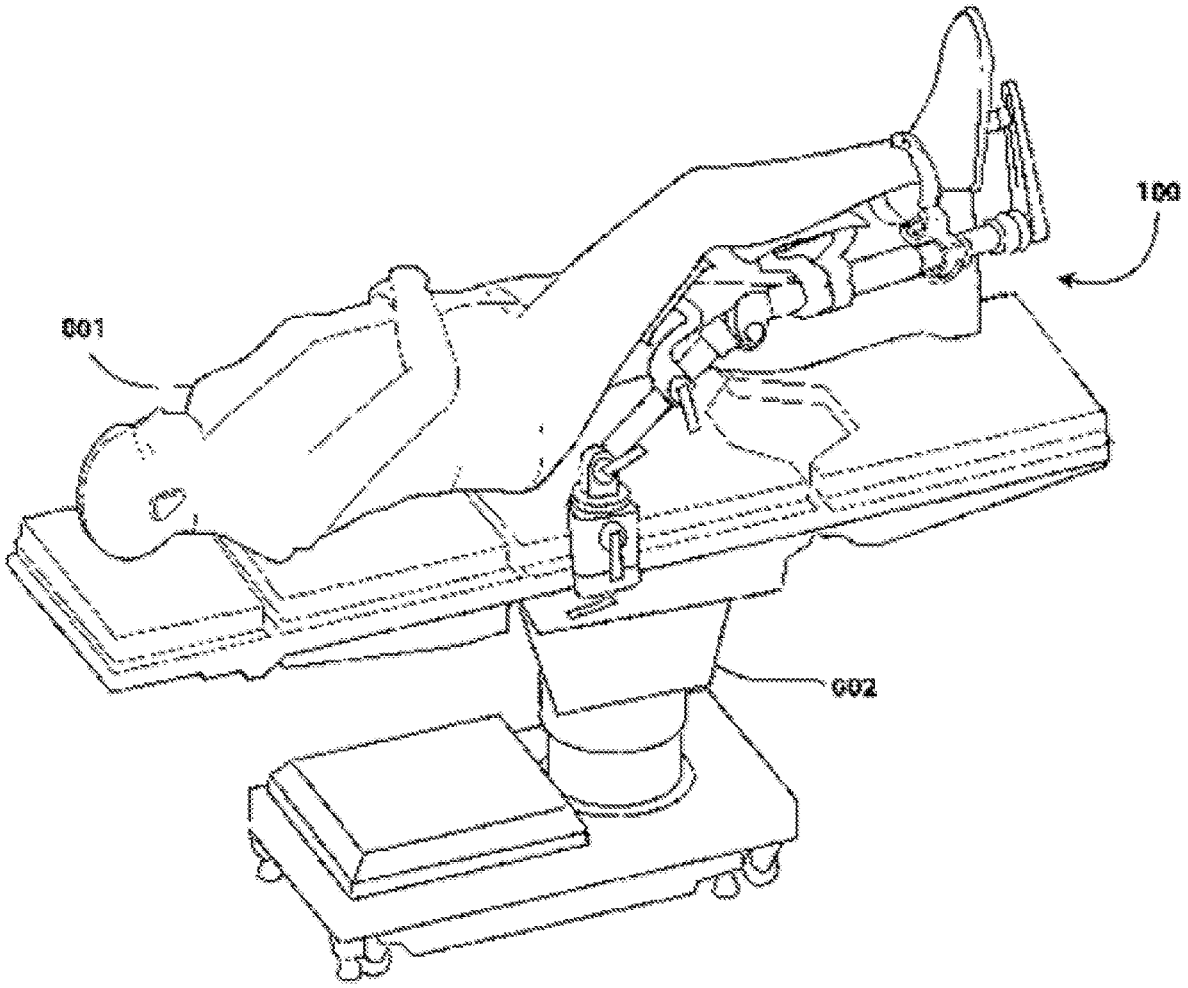
FIG. 1 is an oblique view of the Extremity Surgical Positioning Device with patient's lower extremity positioned in it.
Figure 2:
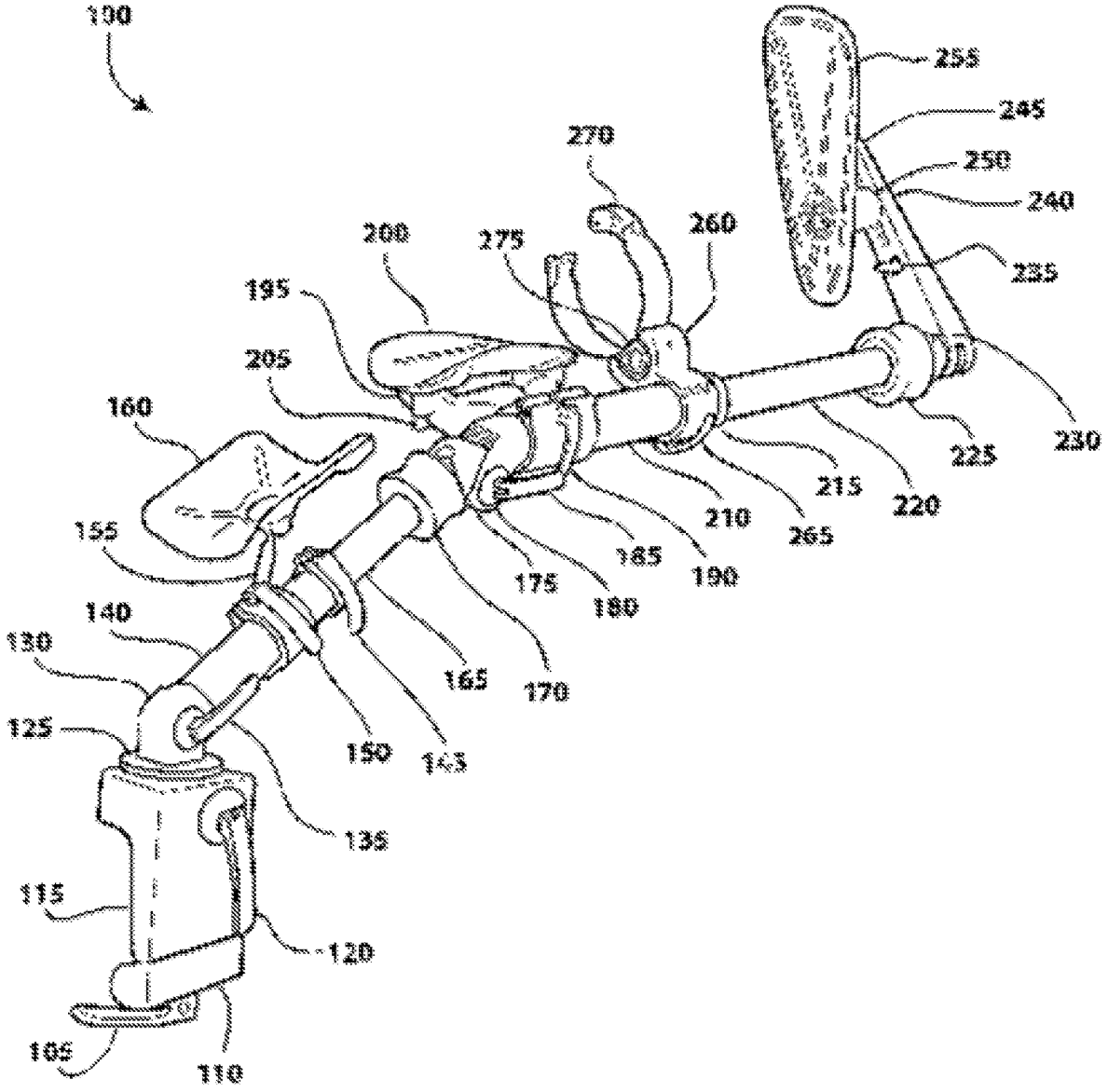
FIG. 2 is an oblique view of the Extremity Surgical Positioning Device with identification markers for referenced characters.

Representative embodiments according to the inventive subject matter are shown in FIGS. 1-2, wherein similar features share common reference numerals.

Description of the Inventive Subject Matter

The inventive subject matter of a multi-purpose positioning device has the following method of operation.

FIG. 1 shows an oblique view of a patient 001, an operating room table 002, an extremity surgical positioning system (hereinafter "positioning system").

FIG. 2 shows an oblique view of the positioning system 100, which shows a table clamp 110, table clamp cam-lock 105, a positioning system base 115, rotary joint cam-lock 120, and a rotary joint 125 connected to proximal hinge 130, with a proximal hinge cam-lock 135, an outer proximal tube 140, outer proximal tube cam-lock 145, proximal limb support cam-lock 150, proximal limb support arm 155, proximal limb support plate 160, inner proximal tube 165, proximal limb distraction/compression ring 170, proximal limb distraction/compression engagement lever 175.

The inner proximal tube 165 is connected to an intermediate hinge 180, an intermediate hinge cam-lock 185, distal limb support cam-lock 190, distal limb support arms 195, distal limb support plate 200, distal limb support plate lock knob 205, outer distal limb tube 210, outer distal tube clocking ring 215, inner distal limb tube 220, distal limb distraction/compression ring 225, distal limb distraction/compression engagement lever 230.

The inner distal tube 220 is connected to a foot/hand support clocking lever 235, foot/hand plate ball joint cam-lock 240, foot/hand support arm 245 connects to a foot/hand plate ball joint 250 and a foot/hand plate 255.

A modular ring support 260 can be attached and locked to the outer proximal tube or outer distal tube with the ring support cam-lock. The ring support ring 270 is held in the ring support 260 by a ring support ring retention pin 275.

The configuration of the aforementioned inventive subject matter should not be limited to any single embodiment described, instead all possible configurations that can be implemented and derived by one skilled in the arts are understood to be embodied herein. Method and Operation of the Inventive Subject Matter The inventive subject matter of a multi-purpose positioning device has the following method of operation.

The patient is placed into position on the operating table. FIG. 1 shows a patient 001, with an extremity surgical positioning system 100, this is mounted to an operating room table 002, via a table clamp 110, and lockable into position with the table clamp cam-lock 105. The lower extremity is placed in the extremity surgical positioning system 100, the proximal lower extremity is placed on the proximal limb support plate 160, the patient's distal lower extremity is placed on the distal limb support plate 200, and the foot is placed against the foot/hand plate 255. The limb is further secured to the support plate via commonly used sterile strapping and wraps.

The length of the outer proximal limb tube 140, and inner proximal limb tube 165, are adjustable to provide for specific patient limb length. This is also used for distraction/compression and is actuated through the proximal limb distraction/compression engagement lever 175, and fine movements are controlled through the proximal distraction/compression ring 170. The length of the outer distal limb tube 210, and inner distal limb tube 220, are adjustable to provide for specific patient limb length. This is also used for distraction/compression and is actuated through the distal limb distraction/compression engagement lever 230, and fine movements are controlled through the distal distraction/compression ring 225. The foot/hand support arm 245, is adjustable for internal/external rotation and/or valgus/varus alignment of the lower limb and is lockable in to position from the foot/hand support clocking lever 235.

The foot/hand plate ball joint 250, can be adjusted for height, flexion, extension, pronation, supination and rotational movements and is lockable into position from the foot/hand plate ball joint cam-lock 240.

This extremity surgical positioning system 100, allows for the use of variety of ring support rings 270, that are placed in a ring support 260, maintained in place by a ring support retention pin 275, and secured to the outer proximal limb tube 140 and/or distal limb tube 210, and lockable into position from the ring support cam-lock 265.

An extremity can be flexed/extended at the proximal joint through the proximal hinge 130, and lockable into position from the proximal hinge cam-lock 135. Abduction/adduction is controlled via the rotary joint 125, and lockable into position via the rotary joint cam-lock 120. Internal/external rotation is controlled through pivoting of the outer proximal limb tube 140, and inner proximal limb tube 165, and lockable from the outer proximal limb tube cam-lock 145.

An extremity can be flexed/extended at the intermediate joint through the intermediate hinge 180, and lockable into position from the intermediate hinge cam-lock 185. Abduction/adduction is controlled via the rotary joint 125, and lockable into position via the rotary joint cam-lock 120.

The materials as depicted in FIG. 2, can be fabricated from materials generally used in operating room environments. These materials may be also constructed from metal, fiberglass, carbon fiber or plastic. The use of wood laminates and/or wood can be utilized. In operating environments where X-Rays will need to be taken while the limb is positioned into the extremity surgical positioning system 100, the material should be fabricated from radio-lucent material.

Certain Advantages of the Inventive Subject Matter Over the Prior Art

The inventive subject matter is a multi-purpose positioning device that can be used for certain surgical procedures, including, but not limited to, ankle arthroscopy, tibia fractures, fibula fractures, bimaleollar/trimaleollar fractures as well as pylon fractures. The inventive subject matter provides for:

multiplanar motion for fracture reduction quick lockdown of a reduction through positioning with distraction and compression control of the varus/valgus drift after reduction provide a consistent, easy to manipulate, control, and measure sterile non-invasive distraction was well as a compression device.

eliminates need for external fixation pins and unnecessary additional surgical wounds.

less trays/equipment to have available on the surgical field.

quick limb position changes for easier surgical approach bilateral wound closure access for surgeon and the assistant raised limb elevation during surgery minimizing need for tourniquet use eliminate need for sand bag/bump under buttock to control ankle/foot neutral position eliminates concerns of lumbar spine clearance eliminates concerns of low back pain complications in patients with past history of low back pain/injury/surgeries devise design provides better surgical site access There is an overall reduction on operation time due to better surgical site access, quicker fracture reduction, faster x-ray time, and faster wound-closure through better positioning.

Referring to FIGS. 3 through 10, a lift apparatus, system and method 300 may be used to lift, position, and set an extremity (e.g. limb) of the patient 1 between a lower position 304 to an upper position 305, or positions there-between. The lift apparatus 300 is configured to be positioned on a bar 302 of an extremity surgical positioning system 100 such as, for example, the outer distal tube 210. The lift apparatus 300 is configured to use mechanical advantage to lift a human limb positioned on the support assembly 360 by manual force alone, e.g. from its use for such applications as lifting and pushing. The lift apparatus 300 may be used in the extremity surgical positioning system 100 to position and lift a support plate 155, 165 and/or support assembly 360 between a lower position 304 to an upper position 305, or positions there-between as desired. For example, for attaching the proximal limb support plate 160 to the proximal limb support arm 155 and/or for attaching the distal support plate 200 to the distal limb tube 210, each described herein and shown in FIGS. 1 and 2. While the lift apparatus, system and method 300 is described to lift, position, and set an extremity of a limb of the patient 1 as shown in FIG. 1, one skilled in the field will recognize that the lift apparatus 300 may be useful for other surgical applications to lift, position, and set other body parts and/or extremities such as, for example, a shoulder or torso.

Figure 3:
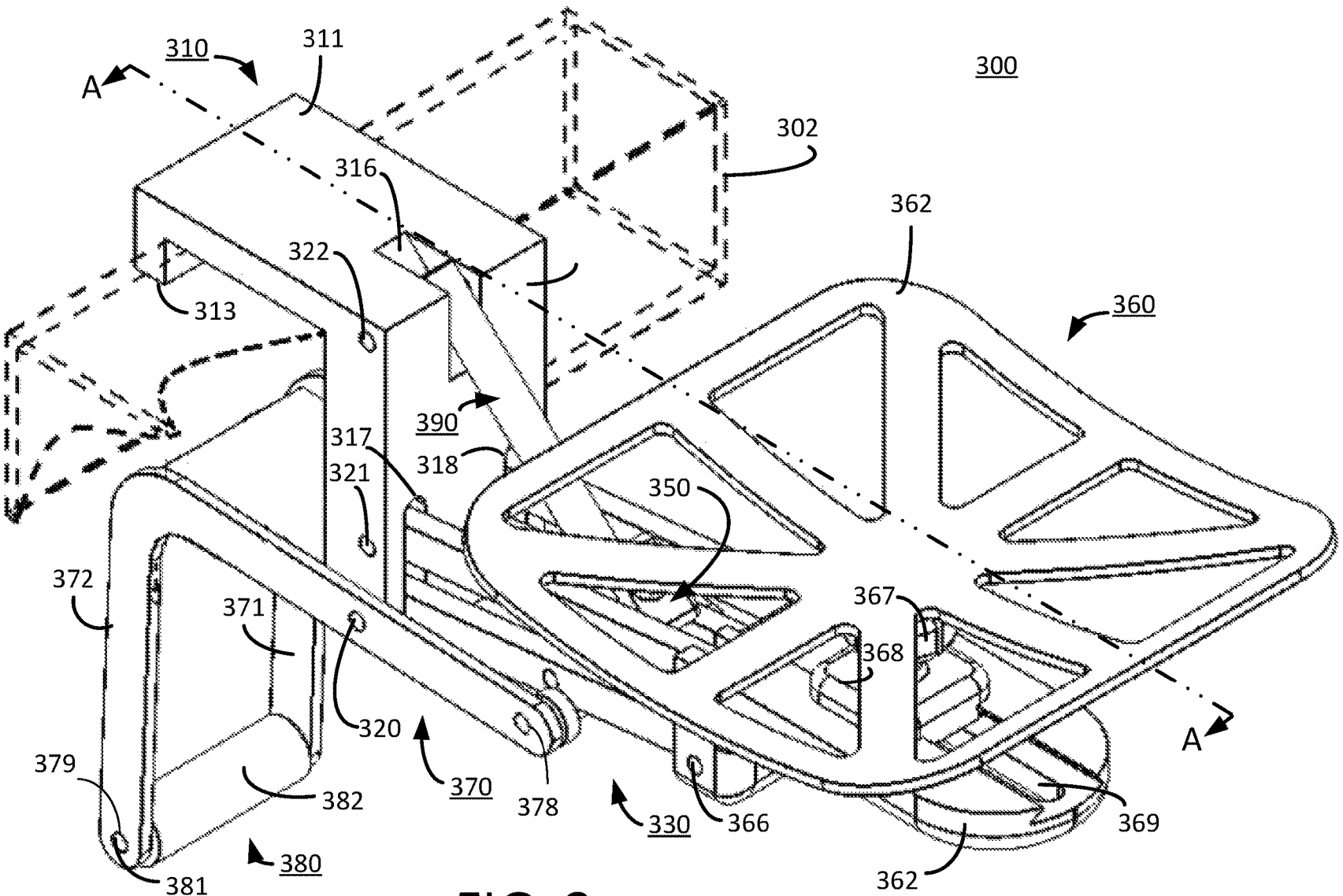
FIG. 3 is a schematic perspective view of a lift apparatus, system and method according to the invention.
Figure 4:
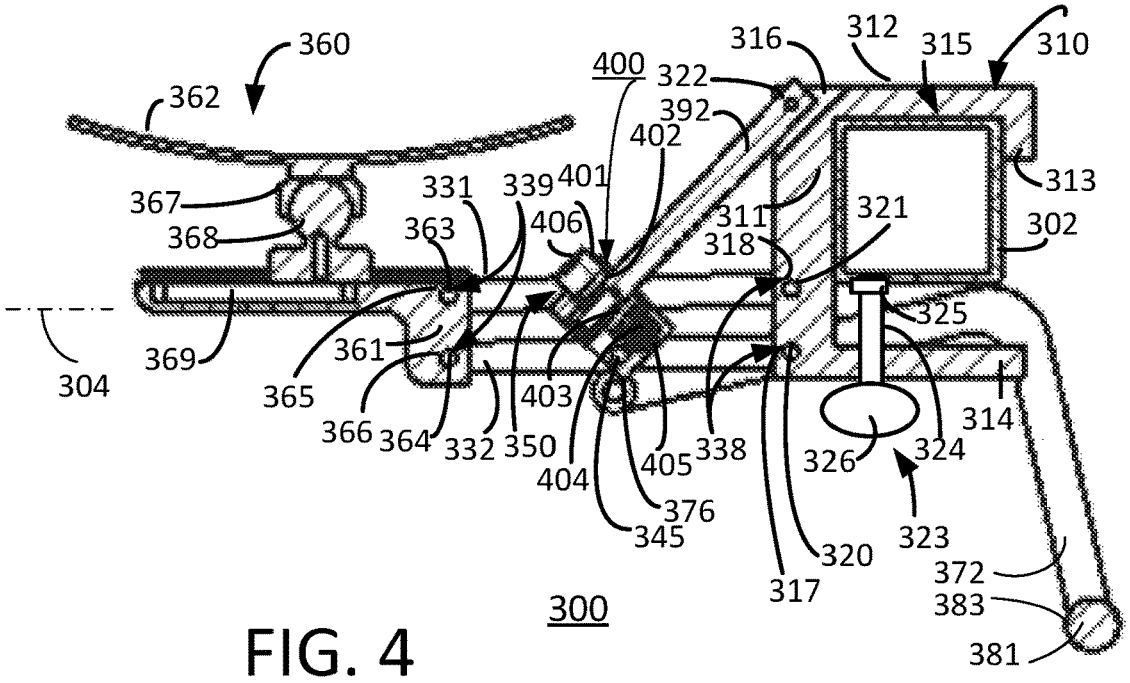
FIG. 4 is a side cross-sectional view, taken along lines A-A of FIG. 3, of the lift apparatus in the lower position.
Figure 5:
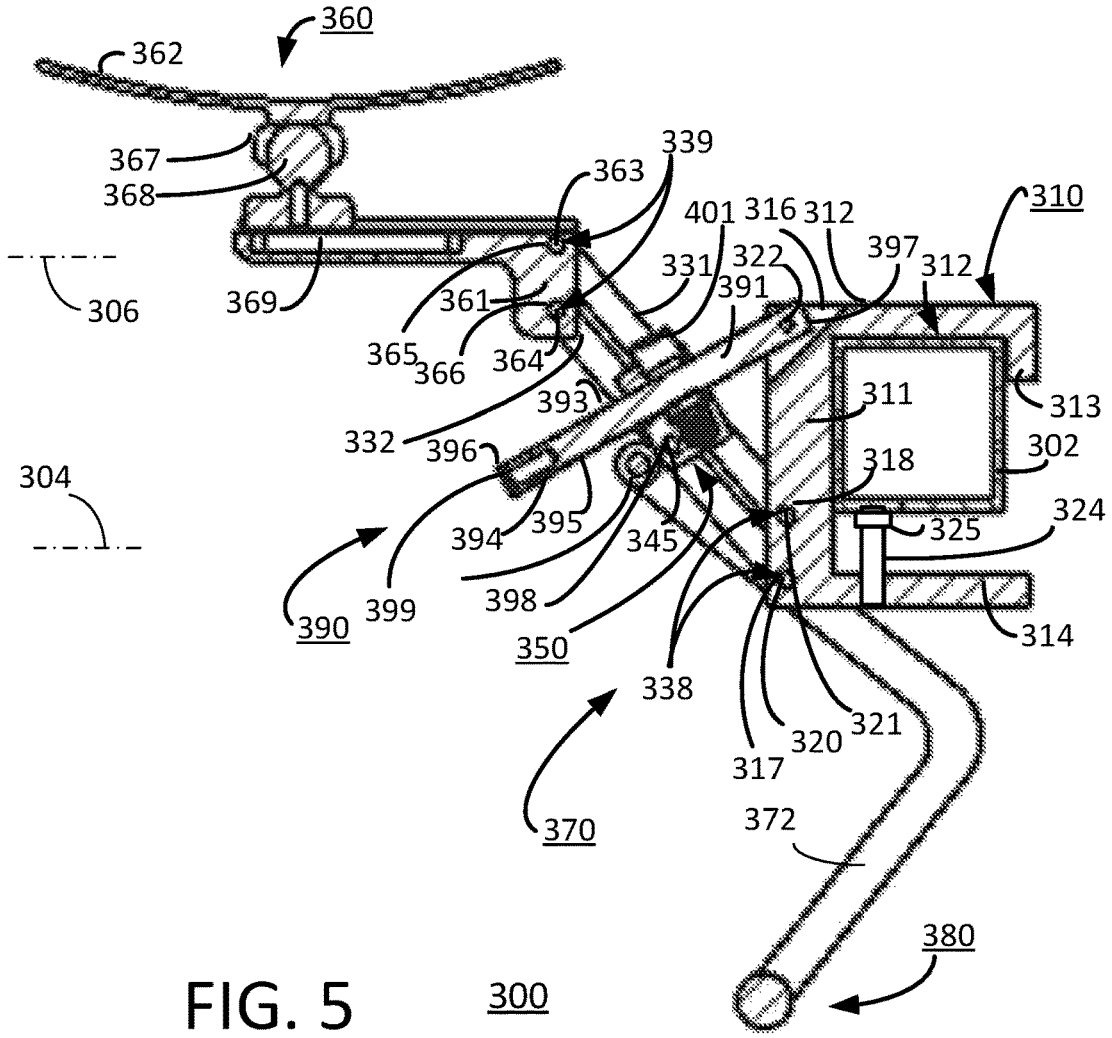
FIG. 5 is a side cross-sectional view, taken along lines A-A of FIG. 3, of the 1 lift apparatus in the upper position.
Figure 6:
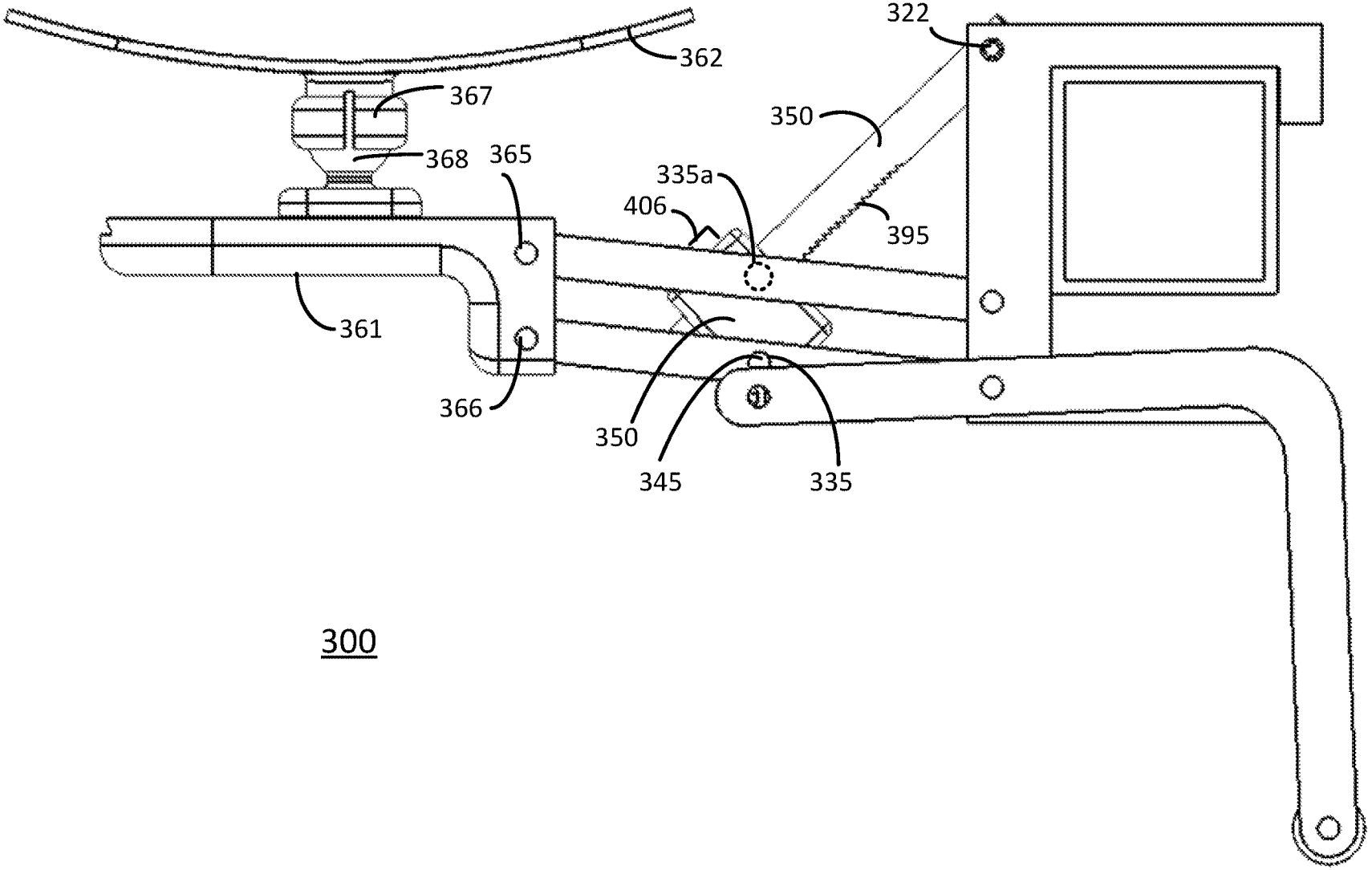
FIG. 6 is a side view of the lift apparatus.
Figure 7:
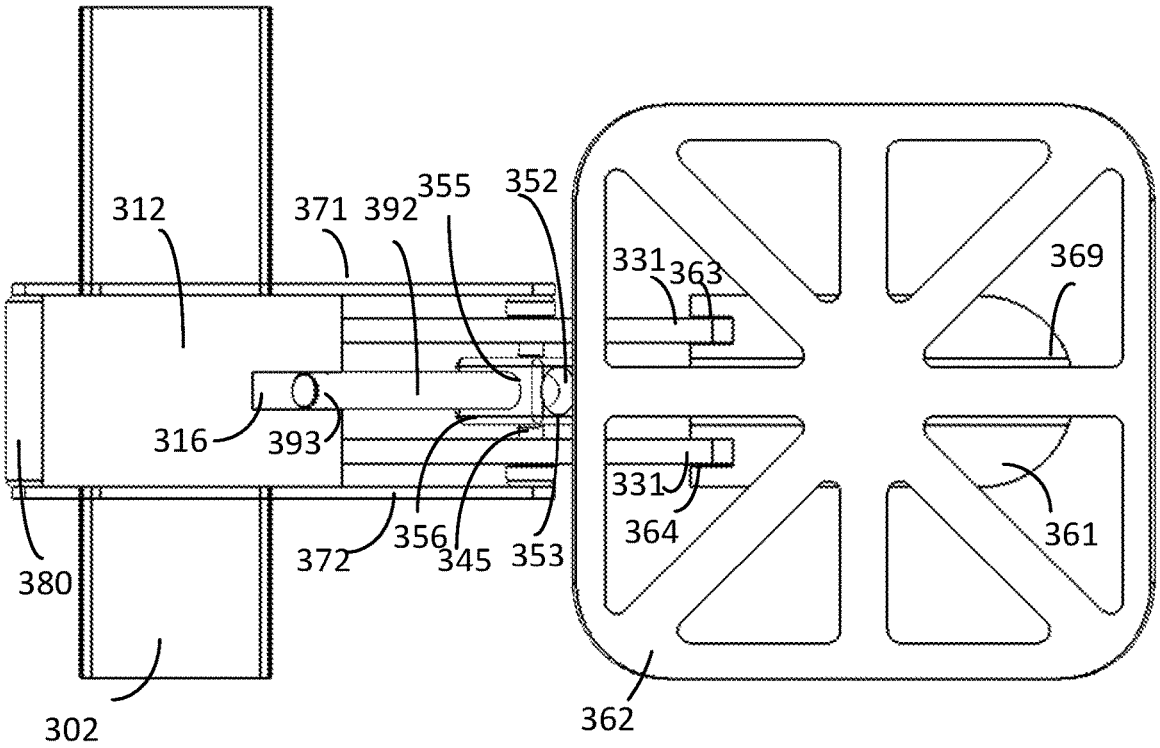
FIG. 7 is a top view of the lift apparatus.
Figure 8:
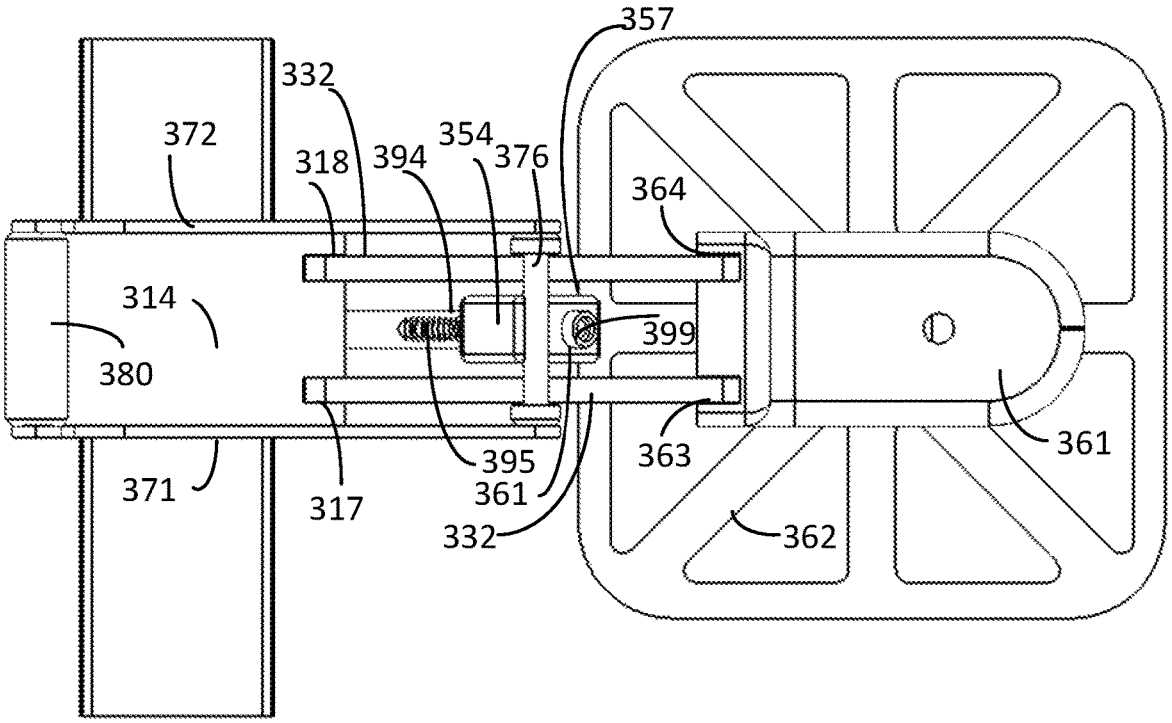
FIG. 8 is a bottom view of the lift apparatus.
Figure 9:
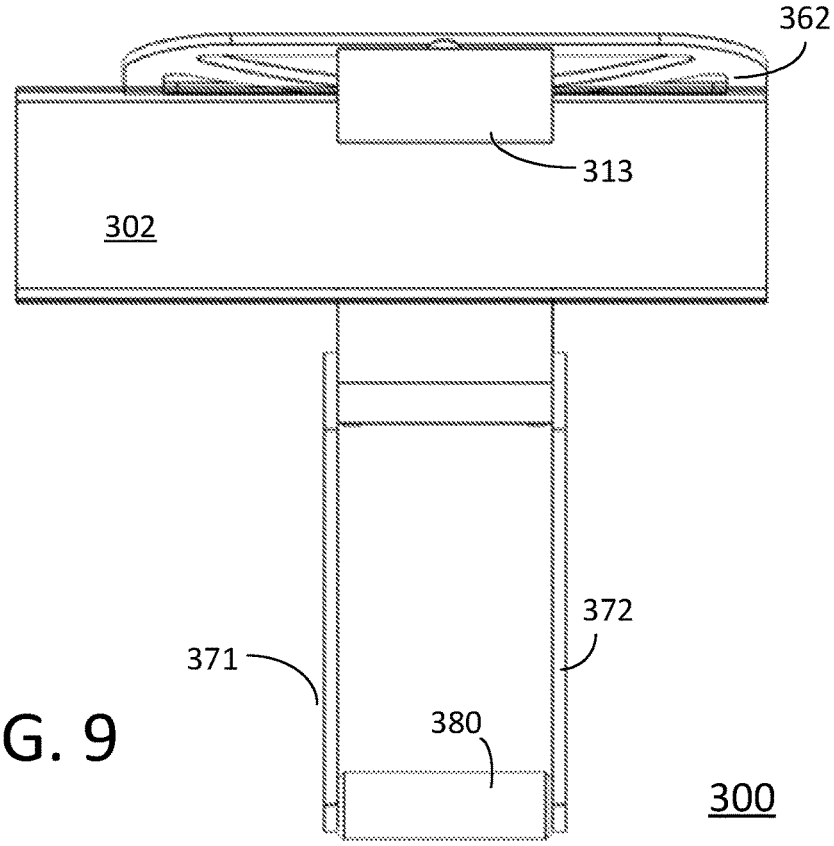
FIG. 9 is a front view of the lift apparatus.
Figure 10:
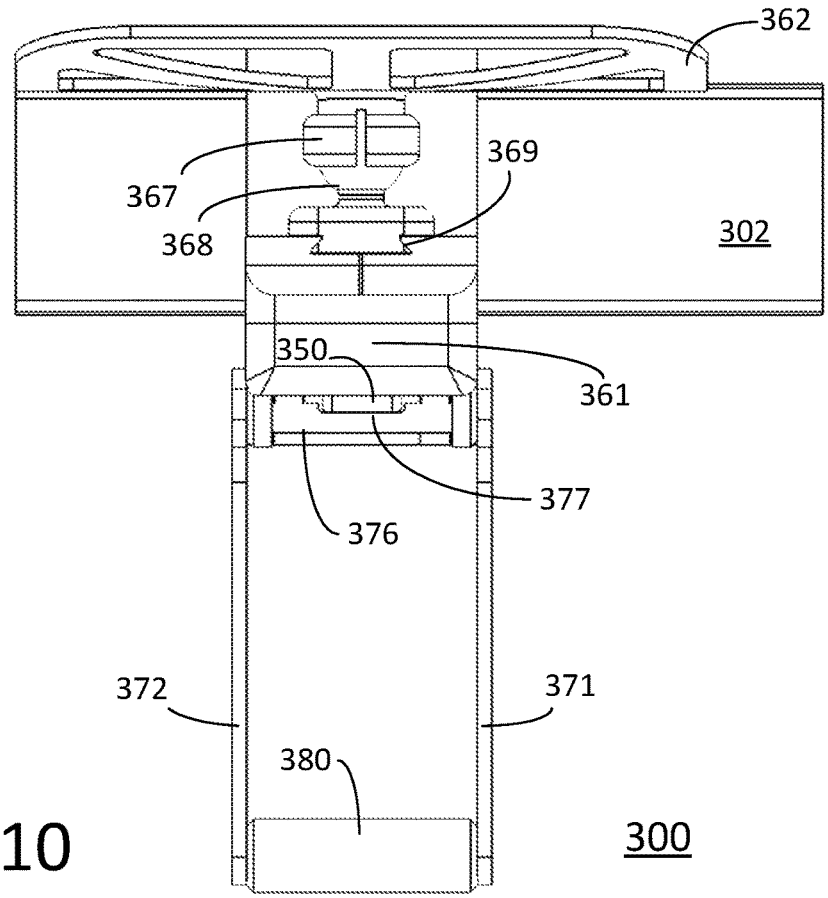
FIG. 10 is a rear view of the lift apparatus.

Referring to FIGS. 3-6, the lift apparatus 300 comprises clamp body 310 operably connected to a support assembly 360 by the interconnections between a lift assembly 330, a runner block assembly 350, a ratchet bar assembly 390, and a pawl assembly 400. A ratchet assembly 370 with a force bar 376 and a handle assembly 380 pivoting around a fixed hinge (pivot) 340 is configured to advance a pawl 403 along a series of equally spaced teeth 395 formed in a ratchet bar 390 so as to raise the support assembly 360 or be lowered by a spring-loaded finger action of the pawl 403 that disengages and/or engages the teeth 395. The bar 302 comprises a solid or hollow tubular construction that may be formed having a substantially triangular, circular, oval, and/or rectangular cross-section as is shown in FIGS. 3-5.

Referring to FIGS. 3 through 6, the lift apparatus 300 comprises an arm clamp body 310 configured to be positioned on the bar 302. The arm clamp body 310 may be formed from materials having suitable strength and durability such as, stainless steel, surgical stainless steels, aluminum, and other metals and metal alloys. The arm clamp body 310 may be formed from solid metal extrusions comprising a body portion 311 extensions formed as an upper section having a lip portion 313 at an end thereof, and a lower section 314. The upper section 312 and lower section 314 form an inner cavity 315 adapted to receive the bar 302 therein and for fastening the clamp assembly 323 thereto.

The body portion 311 further comprises a ratchet arm opening 316 at an upper edge thereof configured for receiving a ratchet arm as is discussed in herein. The clamp body portion 311 comprises one or more openings 317, 318, and 319 (shown in FIGS.) suitable to receive and/or accept one or more pins 320, 321, and/or rods 322 so as to operably connect the lift assembly thereto. The lift apparatus 300 further comprises a clamp assembly 323 for operably connecting to the bar 302. According to an embodiment of the invention, clamp assembly 323 consisting of a threaded shaft 324 with a foot portion 325 of the threaded shaft 324 for operably connecting to the bar 302 using a knob 326 for tightening or loosening of the clamp assembly 323 to the outer distal tube 210.

Referring to FIGS. 3 and 4, the lift apparatus 300 comprises a lift assembly 330 configured with an upper arm 331 and a lower arm 332. Each of the upper arm 331 and the lower arm 332 may be formed having sufficient longitudinal length to span between the arm clamp body 310 and the support assembly 360. Each of the upper arm 331 and the lower arm 332 may be formed from a solid, flat or hollowed tubular construction of sufficient strength and durability to position and hold the limb on the support assembly 360. Each of the longitudinal arms 331, 332 comprises openings formed at each end. For example, an opening 333 for positioning adjacent the body portion 311 and for receiving pin 336 therein may be formed on an end of the upper and lower arms 331, 332. Similarly, an opening 334 for positioning adjacent the support base 361 and for receiving pin 337 therein may be formed on an end of the upper and lower arms 331, 332. Each of the pins 336 secured through the opening 330 of the upper arm 331 in the opening 318 in the body portion 311 forms a hinge (pivot) 338 with the body portion 311. Each of the pins 336 secured through the opening 330 of the lower arm 332 in the opening 317 in the body portion 311 forms a hinge (pivot) 338 with the body portion 311. Similarly, each the pins 337 secured through the opening 334 of the upper arm 331 in an opening 365 in the support base 361 forms a hinge (pivot) 339 with the support base 361. Each of the pins 337 secured through the opening 334 of the lower arm 332 in the opening 366 in the support base 361 forms a hinge (pivot) 339 with the support base 361. A mid-point opening may be formed in one of the longitudinal arms 331, 332, preferably the upper arm 331 for fastening a fastener or rod 345 to the runner block assembly 350 and forming a fixed hinge (pivot) 340.

Referring to FIGS. 4-10, a runner block assembly 350 comprises a body portion 351 with a ratchet opening 352 extending between a top surface 353 and a bottom surface 354, a rod opening 355 extending between a front surface 356 and a rear surface 357 and a plurality of side surface openings 358 formed on each side surface 359 of the body portion 351. The ratchet opening 352 is configured to receive a pawl assembly 400. The rod opening 355 is configured to receive a climbing bar assembly 410. The body portion 351 may be formed with a pushpin assembly opening The plurality of side surface openings 358 may be configured to be positioned adjacent the mid-portion opening 335 one of the longitudinal arms 331, 332 for receiving a fastener 338 therein and securing the fastener 338 to and adjacent one of each of the plurality of side surface openings 358 formed in the runner block assembly 350. Each of the fasteners 345 secured through the mid-portion opening 335 of the lower arm 332 on each side, however, a mid-portion opening 335*a* may be located on the upper arm 331, and the lower arm 332 in the opening 366 in the runner block assembly 350 forms a fixed (pivot) with the runner block assembly 350

Referring to FIGS. 3 and 4, the support assembly 360 comprises a support base 361, a limb platform 362, one or more openings 363, 364 formed in the support base 361 adapted to receive one or more pins 365, 366 therein. The support base 361 may further comprise an adjustment slot 369 configured to slidably operably connect with a ball portion 368 disposed on a base, wherein the ball is configured to be received in a socket 367 of the limb platform. The support base 361 when raised to the upper position 306 and/or lowered to the the lowe position 304 allows the integral ball stand 368 with the limb of the patient 1 thereon to slide in the adjustment slot 369 when operating the lift apparatus 300.

Referring to FIGS. 3 and 4, a ratchet assembly 370 comprises one or more handle arms 371 and 372, each arm configured with an opening 373 positioned at an end to be disposed adjacent the runner block assembly 350, and another opening 374 configured to be form a handle end 380. The ratchet assembly 370 may further comprise a mid-point opening 375 formed in each of the one or more handle arms 371 and 372 configured for positioning adjacent the support base 361 and the lower arm 332 and for receiving therein pin 337 to operably connect the one or more handle arms 371, 372 and the lower arm 332 in the opening 318 in the body portion 311 to form a hinge (pivot) 338 with the body portion 311. On each end 373 of the ratchet arms 371, an opening 378 is configured to receive a force bar 376 and to secure the force bar 376 with fastener 345 between the ratchet arms 371. The force bar 376 may be formed with a flat portion 377 configured on a side adjacent to the runner block assembly 350. The force bar 376 is configured to push and/or operably connect with the longitudinal arms 331, 332 and the runner block assembly 350 so as to slide the bar member 391 and raise the support assembly 360 to locate to the upper position 305 from the lower position 304, or in any intermediary positions. Similarly, on each end 375 of the ratchet arms 371, an opening 379 is configured to receive a handle assembly 380 comprising a cross-member or handle bar 381 and a sleeve 382 that may be formed in a grip 383. The handle bar 381 may be with fastener 345 between the ratchet arms 371. The handle assembly 380 is adapted to apply force to the force bar 376 to push and/or operably connect with the longitudinal arms 331, 332 and the runner block assembly 350 around the hinge (pivot) 338 on the body portion 311.

The ratchet bar 390 comprises a bar member 391 made from metal and/or metal alloy materials of sufficient strength and durability such as, for example, stainless steel, surgical stainless steel, steel-alloys, and other metals and metal-alloys. The bar member 391 comprises a elongated bar body 392 that generally may be formed smooth with at least one smooth portion 393 and a linear rack 394 with series of equally spaced notches or teeth 395. The smooth portion 393 and a linear rack 394 of the ratchet bar 390 interacts with the push pin pawl assembly 400 located in the runner block assembly 350. A body block end 397 of the bar member 391 may be formed with an opening 398 so as to receive the pin 322 thereby securing to ratchet arm opening 316 in the body portion 311 of the arm clamp body 310, whereby once the runner block end 396 of the bar member 391 has been pulled and/or pushed through the runner block assembly 370 and past the pawl 403, and with the body block end 397 fixed to the body portion 311 by the pin 322, a ratchet action of the linear rack 394 prevents the bar member 391 from being pulled back and, in operation, any resulting advances of the pawl 403 along the linear rack 394 raises the support assembly 360. Using the push button pawl assembly 400, a disengaging action can be achieved by the user pushing on the button body 401 that releases the pawl 403 from the linear rack 394, whereby the bar member 391 may slide so as to locate the support assembly 360 to the lower position 304 from the upper position 306, or in any intermediary positions, Referring to FIGS., a pawl assembly 400 comprises a button body 401 may be inserted into the ratchet opening 352 in the body portion 351 of the runner block assembly 350 with the bar member opening 402 aligned with the opening 355. A bias member or spring 404 next may be inserted in the ratchet opening 352 and enclosed using an end cap 405, whereby the end cap 405 provides a force and a compression of the spring 404 between the button body 401 and the end cap 405. The button body 401 may be configured with a bar member opening 402 and a pawl 403 formed in the button body 401 configured to align and receive slidably the bar member 391 there-through. The button body 401 may further have a button cap 405 configured to be received through a button opening 352*a* to provide spring-loaded finger action of the pawl 403 that disengages and/or engages the teeth 395. The button opening 352*a* is dimension smaller than ratchet opening 352 so as to provide a stop wall 352*b* for the button body 401 having the cap 405 extending there-through. The button body 401 may be formed from metal and/or metal alloy materials of sufficient strength and durability such as, for example, stainless steel, surgical stainless steel, steel-alloys, and other metals and metal-alloys. The opening 352 may be formed by milling manufacturing techniques whereby the ratchet opening 352 is milled to a predetermined depth to form the stop wall 352*b* and a dimension of the button body 401 with the button opening 352*a* in a dimension of for the button head 406 subsequently milled therein.

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein.

All patent and non-patent literature cited herein is hereby incorporated by references in its entirety for all purposes.

What is claimed is:

1. A lift for positioning a patient's limb between a lower position and an upper position, the lift apparatus, comprising:

an arm clamp assembly comprising a body portion with a cavity formed by an upper section and lip portion and a lower section of said body portion, said cavity configured to receive and a support member;

a lift assembly configured with one or more upper arms and one or more lower arms adapted to be received in openings formed in said arm clamp assembly and secured thereto by pins;

a runner block assembly comprising a body with a ratchet opening formed between a top surface and a bottom surface, a rod opening formed between a front surface and a rear surface, and an opening on each of a side surface, said opening on each of said side surfaces adapted to receive a fastener for securing to each of said one or more lower arms of said lift assembly to form a fixed pivot;

a ratchet bar comprising a body having a linear rack and a smooth portion, said ratchet bar configured to be received in said ratchet opening at one end and secured to an opening located on an upper end of said body portion of said arm clamp assembly by a pin;

a pawl assembly comprising a button body having a bar member opening and a pawl formed therein adapted to receive said ratchet bar therein;

a support assembly operably connected to said one or more upper arms and said one or more lower arms of said lift assembly by pins, and a ratchet assembly comprising two ratchet arms joined at one end by a force bar and at the other end by a handle, said ratchet assembly being joined at a mid-portion of each of said two ratchet arms to said arm clamp assembly so as to form a hinge.

* * * * *